United States Patent [19]

Davis et al.

[11] Patent Number: 5,005,694

[45] **Date of Patent: * Apr. 9, 1991**

[54] SYSTEM FOR PACKAGING DETONATING CORD FOR TRANSPORT

[75] Inventors: Billy F. Davis; Michael P. Hancock, both of Cleburne; Scott L. Hayes, Burleson, all of Tex.

[73] Assignee: Goex, Inc., Cleburne, Tex.

[ * ] Notice: The portion of the term of this patent subsequent to Jan. 23, 2007 has been disclaimed.

[21] Appl. No.: 376,887

[22] Filed: Jul. 6, 1989

Related U.S. Application Data

[63] Continuation-in-part of Ser. No. 110,227, Oct. 19, 1987, Pat. No. 4,895,249.

[51] Int. Cl.[5] ..... B65D 85/62

[52] U.S. Cl. ..... 206/3; 206/495; 206/591; 102/275.1

[58] Field of Search ..... 206/3, 495, 521, 585, 206/591; 102/202.11, 275.5, 275.9, 275.1

[56] References Cited

U.S. PATENT DOCUMENTS

| | | | |
|---|---|---|---|
| 2,208,873 | 7/1940 | Rosenberg | 206/495 |
| 2,352,998 | 7/1944 | Alexander et al. | 206/3 |
| 2,601,919 | 7/1952 | Darbyshire | 206/3 |
| 3,352,237 | 11/1967 | Turquois | 102/202.11 |
| 3,878,786 | 4/1975 | Ridgeway | 102/202.11 |
| 4,055,247 | 10/1977 | Benedick et al. | 206/591 |
| 4,132,171 | 1/1979 | Pawlak | 102/275.5 |
| 4,248,342 | 2/1981 | King et al. | 206/3 |
| 4,586,602 | 5/1986 | Levey | 206/3 |
| 4,607,573 | 8/1986 | Thureson et al. | 102/275.5 |
| 4,817,787 | 4/1989 | Owen | 206/3 |

*Primary Examiner*—David T. Fidei
*Attorney, Agent, or Firm*—Arthur F. Zobal

[57] ABSTRACT

A detonating cord transport package wherein a continuous length of a metal jacket detonating cord is installed on a plurality of separator-support members such that the detonating cord is formed in a plurality of loops on each separator-support member with the two end portions of each loop being in proximity to each other. In the preferred embodiment, the two end portions of each loop engage each other and cross each other as seen in a given view.

20 Claims, 4 Drawing Sheets

Fig. 1
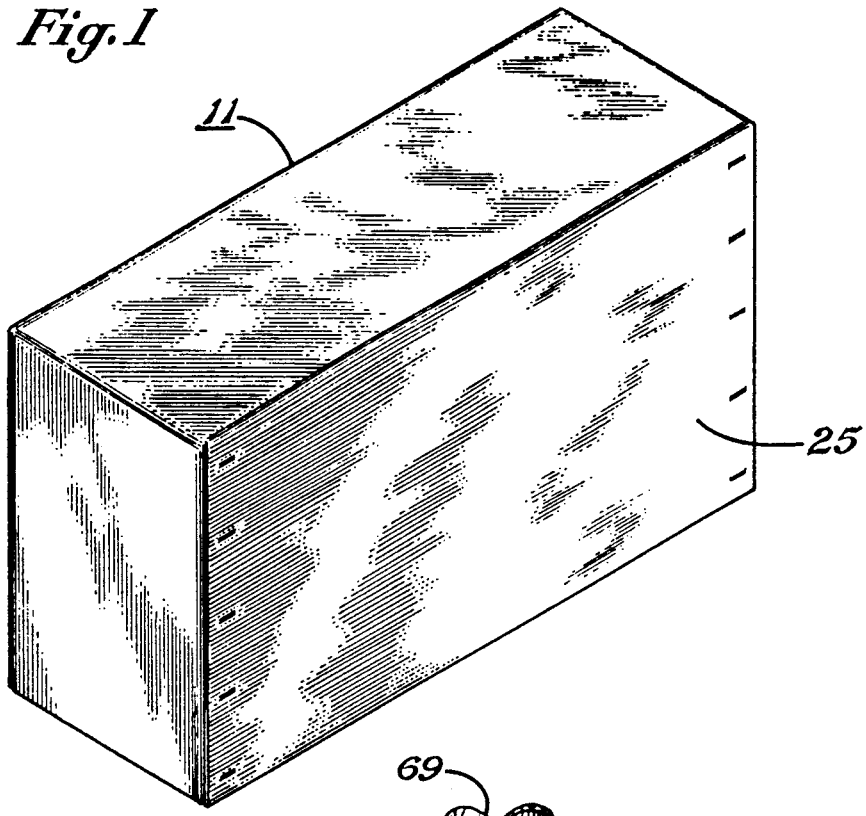
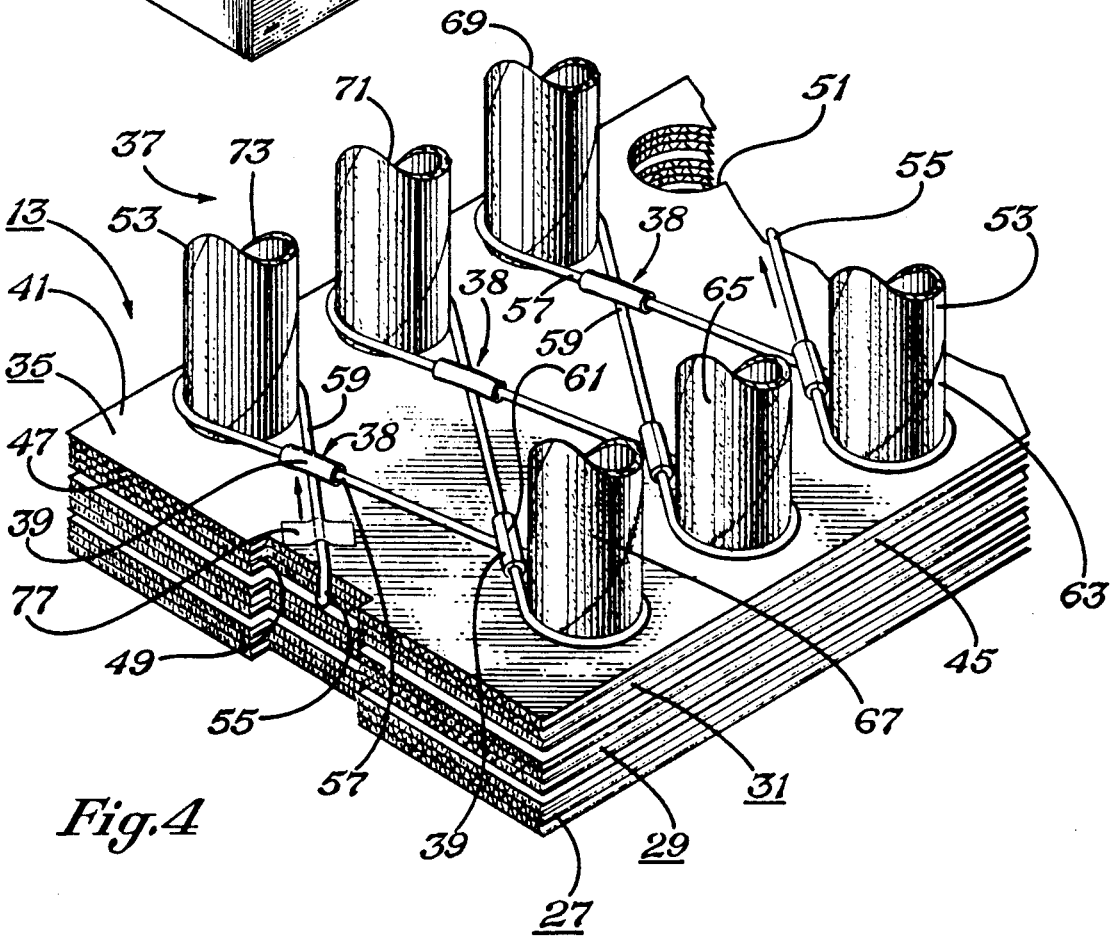
Fig. 4

Fig. 7
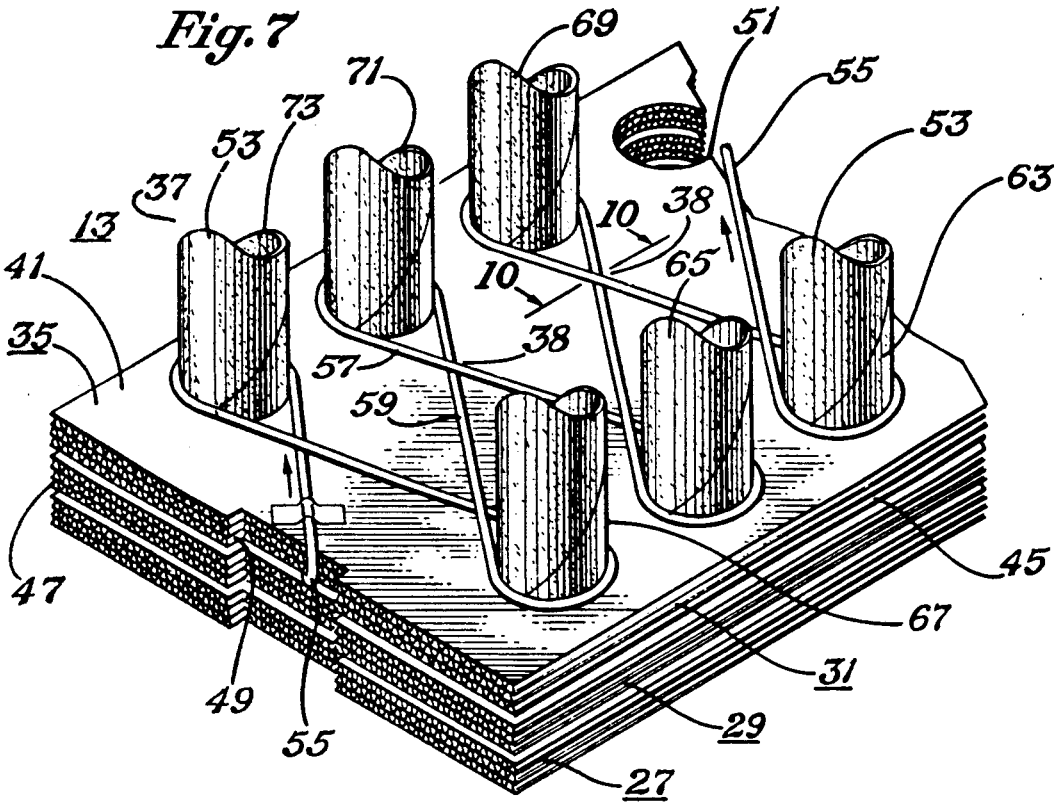
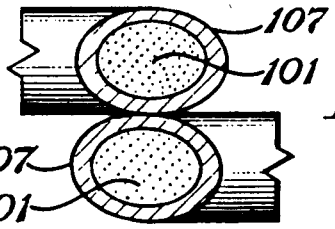
Fig. 10
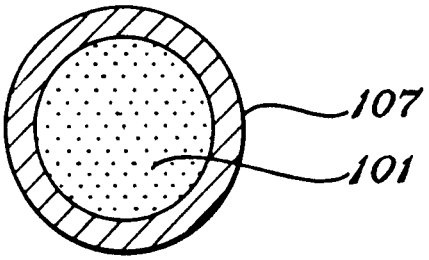
Fig. 8
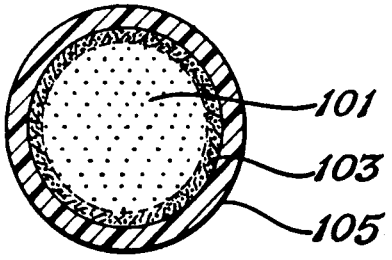
Fig. 9

SYSTEM FOR PACKAGING DETONATING CORD FOR TRANSPORT

This application is a continuation in part of U.S. Pat. Application Ser. No. 07/110,227 filed on Oct. 19, 1987 now U.S. Pat. No. 4,895,249.

FIELD OF THE INVENTION

The invention relates to the transporting of detonating cord and more particularly to systems for use in the packaging of detonating cord for transport.

BACKGROUND OF THE INVENTION

Detonating cord is used extensively in the petroleum exploration and production industry to initiate the detonating of explosive materials in various types of downhole tools, such as perforating tools, setting tools, and the like. The borehole sites at which such tools and associated detonating cord are used are scattered worldwide, as are the relevant manufacturing, supply and service facilities. Consequently it is highly desirable that such tools, as well as the associated detonating cord be shipped by air from the supply facility location to the location of the using facility. However, the regulations governing the shipment of explosive materials by air are quite stringent. Basically, the regulations require that the explosive materials be packaged such that any ignition or detonation shall be confined to that container and will not propogate to another container.

U.S. Pat. No. 4,586,602 and U.S. Pat. Application Ser. No. 07/110,227 disclose detonating cord transport systems that meet the above mentioned air shipping regulations for explosive materials. These systems disclose the use of a severing medium between cord portions which are located in proximity to each other in order to cause the cord to sever itself upon the occurrence of any detonation. The actual detonating cords which have been used in these systems are detonating cords having a soft jacket.

Upon further investigation, it has been found that a severing medium is not needed between the detonating cord portions in a system wherein the detonating cord packaged has a metal jacket. In fact it has been found that in a packaging system for a detonating cord having a metal jacket, the use of a severing medium does not effectively work to terminate a detonation which may occur.

SUMMARY OF THE INVENTION

It is an object of the invention to provide a new and useful detonating cord transport package utilizing a detonating cord with a metal jacket disposed on support members to effectively stop any detonation which may occur.

It is a further object of the invention to provide a detonating cord transport package comprising a plurality of separator-support members located in layers with a continuous length of detonating cord having a metal jacket disposed on each separator-support member such that at a plurality of locations two cord portions are in proximity with each other.

In the embodiment disclosed, the detonating cord is formed in a plurality of loops on each separator-support member with the two end portions of each loop being in proximity to each other.

In the preferred embodiment, the two end portions of each loop engage each other and cross each other as seen in a given view.

The detonating cord having a metal jacket comprises an explosive core surrounded by the metal jacket or sleeve.

BRIEF DESCRIPTION OF THE DRAWINGS

FIG. 1 is an isometric view of an assembled detonating cord transport system.

FIG. 4 is a fragmentary isometric view showing steps in the winding of detonating cord on a section that are subsequent to the steps shown in FIG. 3.

FIG. 7 is a fragmentary isometric view similar to that of FIG. 4 but showing the detonating cord disposed on one side of a separator-support member without the use of severing mediums.

FIG. 8 is a cross-section of a detonating cord having a metal jacket.

FIG. 9 is a cross-section of a detonating cord having a soft jacket.

FIG. 10 is a cross-section of FIG. 7 taken through lines 10—10 thereof with the detonating cord of FIG. 8 utilized.

DESCRIPTION OF THE EMBODIMENTS OF FIGS. 1-10

Figure 2:
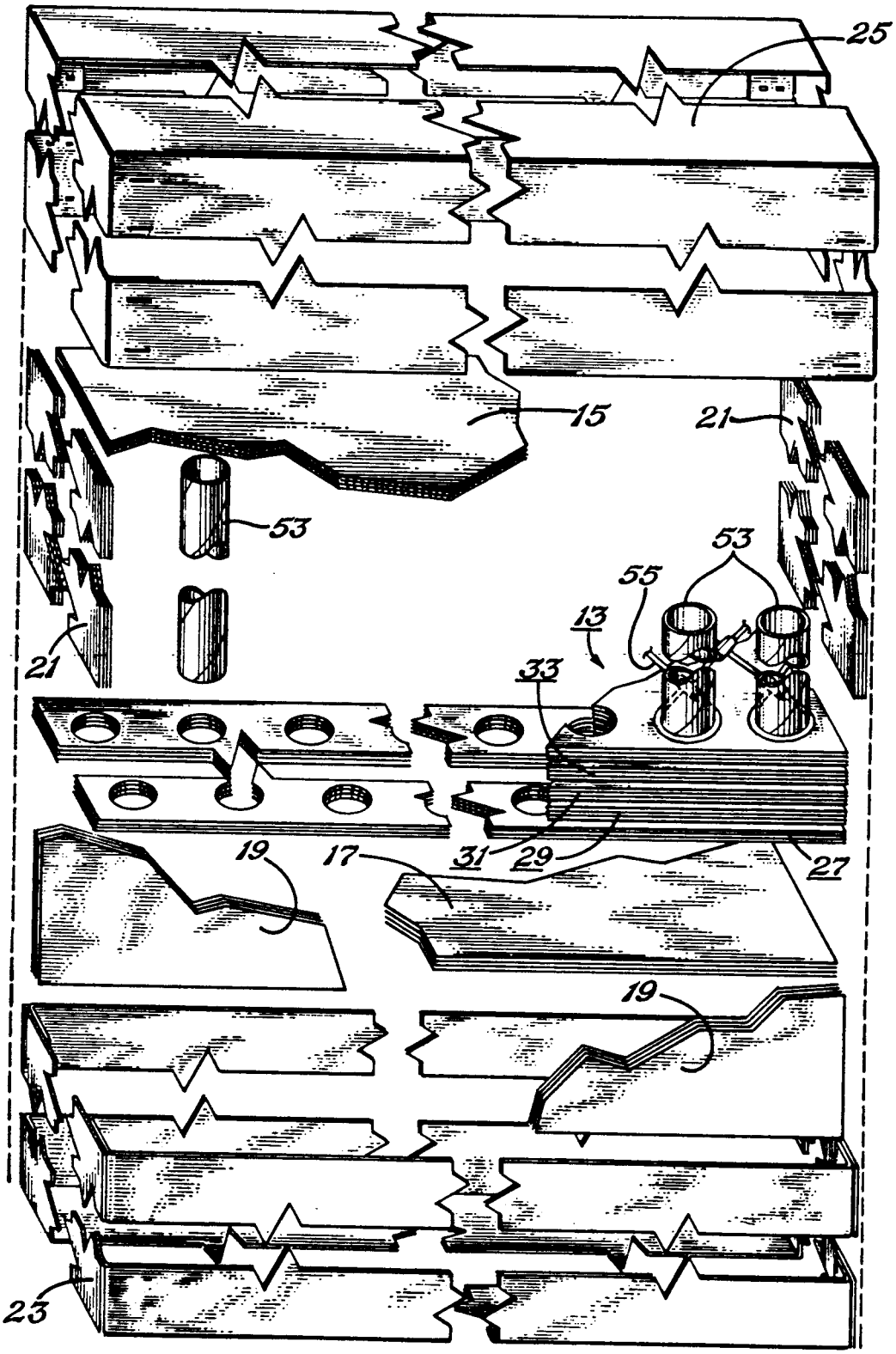
FIG. 2 is a fragmentary exploded isometric view showing portions of the detonating cord transport system of FIG. 1.

Referring to FIGS. 1-4, a detonating cord transport system is identified by reference numeral 11. The detonating cord transport system 11 includes a detonating cord transport package 13 which is surrounded by top, bottom, side and end baffle members 15, 17, 19, 21 respectively, and placed in a telescoping type container having inner and outer parts 23, 25.

Figure 3:
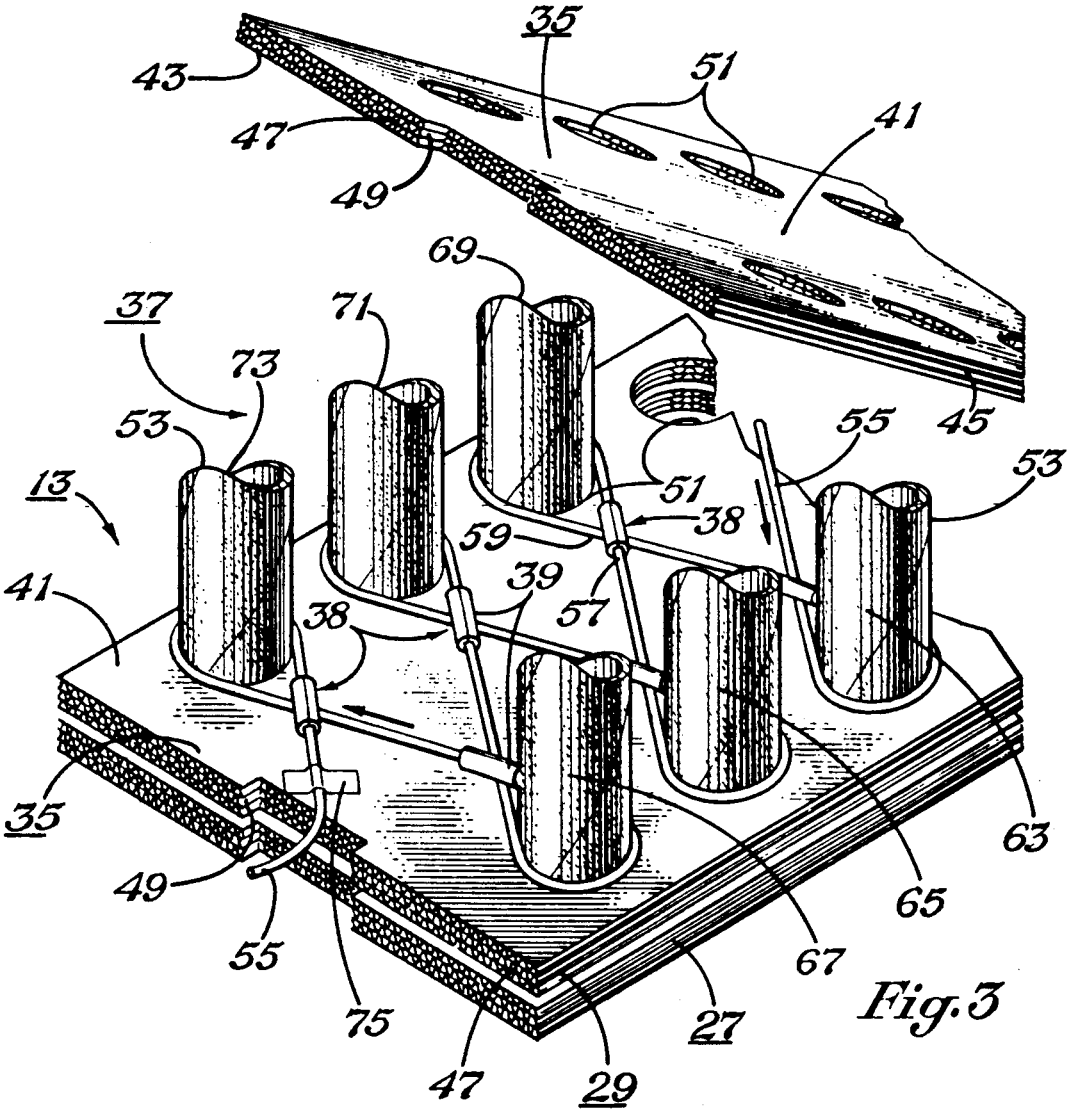
FIG. 3 is a fragmentary isometric view showing steps in the winding of detonating cord on a section.

The detonating cord transport package 13 is made up of a plurality of sections 27, 29, 31, 33. As shown in FIGS. 3 and 4, each transport package section includes a separator-support member 35, winding support means 37, and severing means 39. Each separator-support member 35 has a front face surface 41, a back face surface 43, side edge surfaces 45 and end edge surfaces 47. Opposite end edge surfaces are provided with end edge notches 49 which are centered on the end edge surfaces 47. Each separatorsupport member 35 has a plurality of circular openings 51 that extend therethrough and communicate between the front and back face surfaces 41, 43. The circular openings 51 are arranged in two rows near the respective side edge surfaces 45. The respective openings 51 are positioned in the same relative positions on each separator-support member 35 so that when the separator-support members are stacked (as will be explained in more detail hereinafter), the respective openings of each separator-support member are aligned with the respective opening of the other separator-support members thereby forming channels through the stack of separator-support members.

The winding support means 37 includes a plurality of columnar winding support members 53. Each winding support member 53 is a cylindrical tube that can be received by any of the openings 51 on a separatorsupport member 35, and therefore can extend through any one of the channels formed by the openings 51 in a stack of separator-support members 35. Each section thus includes a portion of the length of each winding support member 53 that projects from the separator-support member front face surface 41. The openings 51 and the winding support members 53 are sized to provide a mating fit so as to preclude the spread of a detonation from one section to other sections. The cyclindrical winding support members are of substantially the same length.

As shown in FIGS. 3 and 4, a continuous length of the detonating cord 55 to be packaged is windingly disposed on the winding support members 53, traversing portions of the respective separator-support member front face surface 41 such that there are a plurality of severing locations 38 on the front face surface 41. At each severing location 38, a first detonating cord portion 57 is disposed in proximity with a second detonating cord portion 59, and a portion of the severing means 39 is interposed between the first and second detonating cord portions The severing means 39 as shown is a piece of nylon reinforced rubber hose which has a longitudinal slit 61 for installation onto a portion of the detonating cord 55 and which is sometimes hereinafter referred to as severing means hose 39.

A method of packaging detonating cord will now be described with reference to FIGS. 3 and 4. In describing the method of packaging detonating cord, it will be convenient to refer to first, second and third "near" winding support members 63, 65, 67 and to first, second and third "far" winding support members 69, 71, 73 with reference to the orientations of FIGS. 3 and 4 on the drawing sheets. Referring particularly now to FIG. 3, the section 29 is completed by winding the detonating cord 55 on the first near winding support member 63 in a counterclockwise direction, and then over the detonating cord at a first severing location where a severing means hose 39 is interposed between the two detonating cord portions by opening its longitudinal slit 61 wide enough to allow the insertion of the respective detonating cord portion through the slit and into the hose, and onto the first far winding support member 69 on which the detonating cord is wound in a clockwise direction, and then over the detonating cord at a second severing location where a piece of severing means hose 39 is installed and onto the second near winding support member 65 on which the detonating cord is wound in a counterclockwise direction, and then over the detonating cord at a third severing location where a piece of severing means hose is installed and onto the second far winding support member 71 on which the detonating cord is wound in a clockwise direction, and then over the detonating cord at a fourth severing location where a piece of severing means hose is installed and onto the third near winding support member 67 on which the detonating cord is wound in a counterclockwise direction, and then over the detonating cord at a fifth severing location where a piece of severing means hose is installed and onto the third far winding support member 73 on which the detonating cord is wound in a clockwise direction, and then over the detonating cord at a sixth severing location where a piece of severing means hose is installed and onto the respective end edge notch 49 where the detonating cord is secured to the front face surface of the separator-support member 35 by a piece of tape 75, thus completing the section 29. The next separator-support member 35 is positioned over the winding support members 53 such that the separator-support member circular openings 51 are aligned with the winding support members. The separator-support member 35 is then pushed down along the lengths of the winding support members until the back face surface 43 of the separator-support member abuts the severing means hoses 39. Referring to FIG. 4, the next section 31 is begun by bringing the detonating cord 55 up through the adjacent end edge notch 49 of the uppermost separator-support member 35 and on to the front face surface 41 where the detonating cord is secured by a piece of tape 77. The detonating cord is wound onto the third far winding support member 73 in a counterclockwise direction and then over the detonating cord at a first severing location where a piece of severing means hose 39 is installed and onto the third near winding support member 67 on which the detonating cord is wound in a clockwise direction, and then over the detonating cord at a second severing location where a piece of severing means hose 39 is installed and onto the second far winding support member 71 on which the detonating cord is wound in a counterclockwise direction, and over the detonating cord at a third severing location where a piece of severing means hose is installed and onto the second near winding support member 65 on which the detonating cord is wound in a clockwise direction, and then over the detonating cord at a fourth severing location where a piece of severing means hose is installed and onto the first far winding support member 69 on which the detonating cord is wound in a counterclockwise direction, and then over the detonating cord at a fifth severing location where a piece of severing hose is installed and onto the first near winding support member 63 on which the detonating cord is wound in a clockwise direction, and then over the detonating cord at a sixth severing location where a piece of severing means hose is installed and so on until the respective end edge notch of the separatorsupport member is reached, thereby completing the section 31.

The detonating cord transport package 13 is begun by initially winding the detonating cord 55 on those portions of the winding support members that are associated with the bottommost section 27. The steps for winding detonating cord on the section 31 as described above with reference to FIG. 4 are followed in winding the detonating cord on the bottommost section 27, but with the following exception: Instead of bringing the detonating cord up through an end edge notch, the starting end portion of the detonating cord is taped in position near the respective end edge notch on the front face surface of the bottommost separator-support member 35.

Additional separator-support members 35 can be added in stacked sequence and the above steps repeated to create new sections. The number of sections which make up a package 11 is determined by the length of detonating cord that can be wound on a section and by the total length of detonating cord that is desired in that package.

The severing means hoses 39 are positioned at the severing locations such that each hose encompasses one of the detonating cord portions and extends beyond the side of the other of the detonating cord portions. Thus, for example, in FIG. 4, the severing means hose 39 at the first severing location encompasses the first detonating cord portion 57 and extends beyond the sides of the second detonating cord portion 59.

When the uppermost section has been finished, the detonating cord package 11 is completed by binding the sections together with strapping tape (not shown). The package 11 is then placed on top of the bottom baffle member 17 and inside of the telescoping container inner part 23 (see FIG. 2). Side and end baffle members 19, 21 are inserted around the detonating cord transport package 11 and the top baffle member 15 is placed on top of the package. The telescoping container outer part 25 is then placed over the inner part 23. The result is the detonating cord transport system 11 of FIG. 1.

Figure 5:
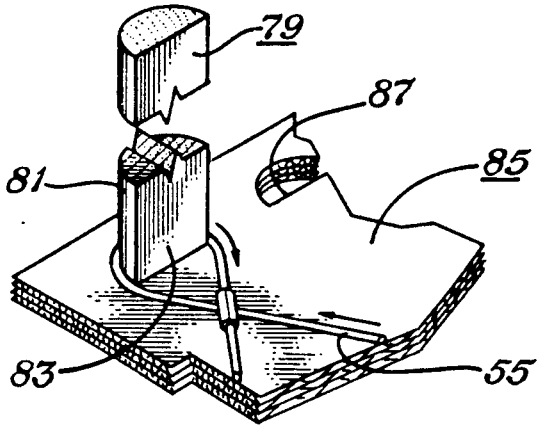
FIG. 5 is a fragmentary isometric view showing a winding support member in accordance with another embodiment.

Details of a winding support member 79 in accordance with another embodiment are shown in FIG. 5. The winding support member 79 of FIG. 5 is also columnar but is semicylindrical in shape. The winding support member 79 is oriented such that the detonating cord is wound on the curved portion 81 of the winding support member instead of on the flat portion 83. This orientation prevents damage to the detonating cord 55 by eliminating sharp corners over which the detonating cord must be wound. The separatorsupport member 85 has semi-circular openings 87 cut to matingly receive the semi-cylindrical winding support member 79.

Figure 6:
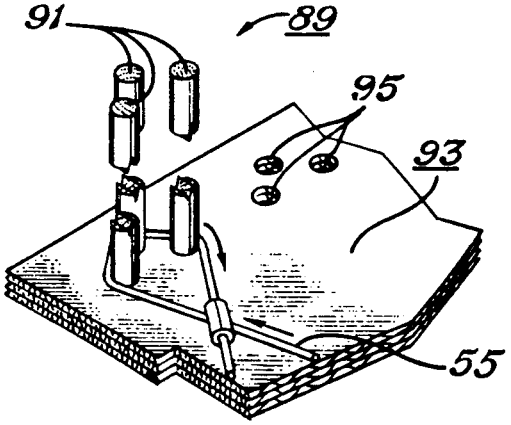
FIG. 6 is a fragmentary isometric view showing a winding support arrangement in accordance with a further embodiment.

In FIG. 6, there are shown details of a winding support means in accordance with another embodiment. In this embodiment, the winding support means includes a plurality of columnar winding support arrangements 89. Each winding support arrangement 89 includes a plurality of columnar members 91 of smaller diameter than the winding support members 53. The separator-support member 93 has a separate opening 95 for each columnar member 91. The columnar members are oriented such that the detonating cord 55 bears on all three columnar members 91. The columnar members 91 are preferably wooden dowels, but they may be rods or tubes of other suitable materials such as cardboard or plastic.

The purpose of the detonating cord transport package is to accomplish the objective that any ignition or detonation of the detonating cord that is initiated anywhere within the detonating transport package (when the package is installed in the container as described herein with reference to FIGS. 1 and 2) shall be confined within the detonating cord transport package container and will not propagate to another container. The operation of the detonating cord transport package is that a detonation of the detonating cord initiated at any location on or within the detonating cord transport package will of course travel in opposite directions from the ignition point, but will be stopped by the first severing location encountered in both directions.

In the embodiment shown by FIGS. 2 through 4, the separator-support members may be typically of such size (about 43 inches in length and 14 inches in width) as to accommodate about 25 feet of detonating cord. The detonating cord is typically packaged in 20 layers or sections so that 500 feet of detonating cord can be shipped in one container. Such a 20 section package is about 24 inches in height. With the illustrated arrangement the maximum length of detonating cord that would be detonated as a result of an ignition would be about one foot for a transport package section. This would occur when the ignition point is on a loop of detonating cord extending from a severing location to a winding support member and back to the severing location, with each such loop being about one foot in length. The total detonation that can occur as a result of an ignition in the detonating transport package is insufficient to result in propagation from one container to another.

An important aspect is the increased economy and efficiency with which detonating cord can be packaged for shipment. The continuous length of detonating cord that is disposed on a separator-support member must have numerous changes of direction so that the cord can pass in proximity to itself at the severing locations. These changes in the direction of the detonatng cord are achieved by disposing the cord on the separator-support member so as to have a winding path. The winding support means, which is wholly accessible from the front face surface of the separatorsupport member, allows the winding disposition of detonating cord on the separator-support member such that the cord is disposed without having to manipulate the separator-support member, thus resulting in a reduction of labor. The amount of labor required in packaging detonating cord is further reduced by the ease of installation of the severing means onto the detonating cord at each severing location. Due to the increased efficiency in packaging detonating cord, increased quantities of detonating cord can be economically packaged.

The winding support means need not extend through the separator-support members and need not be columnar. Each separator-support member may have a dedicated winding support means that does not extend to the adjacent separator-support members.

The winding support members can have shapes other than the cylindrical or semi-cylindrical shapes described herein so long as the detonating cord which is wound on the winding support members is provided with sufficient turning radius (about a one-half inch minimum) in order to prevent damage to the detonating cord. It has been found in practice that a satisfactory size for a cylindrical winding support member is 2½ inches in diameter. Similarly, the columnar members of a winding support arrangement can have shapes other than the cylindrical shape described herein and can be arranged in other configurations so long as the detonating cord is wound with an acceptable turning radius as discussed above. The columnar members 91 shown in FIG. 6 may typically have a ⅜ inch diameter.

The severing means can utilize forms and materials other than the nylon reinforced hose pieces shown and described. For example, the hose piece need not entirely encompass the detonating cord. Also, any material that will effectively accomplish the requisite severing action may be used, and it may take any form that can be conveniently installed.

The manner of winding detonating cord and the disposition of the winding support members may vary from that shown and thus far described so long as the requisite severing locations are provided. For example, the detonating cord may be wound such that it progresses back and forth from near row to far row to near row, etc., with no crossovers. With such an arrangement suitable means would be provided to cause the detonator cord to pass in close lateral proximity with itself at severing locations located between the near and far rows of winding support members. Severing means would be installed between the two portions of detonating cord at each severing location.

It has been found in practice that the separatorsupport members can be layers of cardboard. In the embodiments shown, three layers of about one-fourth inch thick corrugated cardboard are used. It has also been found in practice that the winding support members 53 can be cardboard tubes. Other materials capable of performing the requisite functions could also be used in the separatorsupport members and in the winding support members.

In the systems of U.S. Pat. No. 4,586,602 and U.S. Pat. Application Ser. No. 07/110,227, the detonating cord used has been a detonating cord with a soft jacket. A soft jacket detonating cord is shown in cross section in FIG. 9. It comprises an explosive core 101 surrounded by a flexible textile braid 103 which in turn is surrounded by a flexible sheath 105 of plastic. Four such soft jacket detonating cords which have been used are identified as PETN explosive, RDX cord, HMX and PYX manufactured by EnsignBickford of Simsbury, Connecticut.

The PETN explosive soft jacket detonating cord has an explosive core of pentaerythritol tetranitrate; a textile braid of nylon/polyester; and a flexible sheath of polyethelene. It has a temperature rating of 250° F. By temperature rating is meant the temperature to which the cord can be subjected for one hour without decomposing. At temperatures above this temperature the cord will explode or decompose. At a temperature rating of 250° F. the PETN explosive cord can be subjected to a temperature of 250° F. for one hour without exploding. At temperatures above 250° F. it will explode or decompose.

The RDX soft jacket detonating cord is identified as Research and Develop Explosive and has an explosive core of cyclotrimethylene trinitramine; a flexible textile braid of nylon/polyester; and a flexible sheath of nylon. It has a temperature rating of 325° F.

The HMX soft jacket detonating cord has an explosive core of cyclotetramethylene tetranitramine; a low shrinkage flexible textile braid; and a flexible sheath of nylon. It has a temperature rating of 400° F.

The PYX soft jacket detonating cord has an explosive core of 2,6-Bis(Picrylamino)-3,5-Dinitropyridine; a flexible textile wrap; and a flexible sheath of Teflon.

In some boreholes, the high temperatures may cause longitudinal shrinkage of the soft jacket detonating cords by as much as 2–4% resulting in the cords being pulled out of some of the explosives charges in the event that a relatively long detonating cord is used. Although more expensive, the problem can be avoided with the use of a metal jacket detonating cord. Three such metal jacket detonating cords are identified as HMX, HNS and PYX all manufactured by Ensign-Bickford of Simsbury, Connecticut. A metal jacket detonating cord is shown in cross-section in FIG. 8. It comprises an explosive core 101 surrounded by a thin, flexible metal jacket 107. The explosive core and temperature rating of the HMX metal jacket detonating cord are the same as that of the HMX soft jacket detonating cord. The metal jacket is of lead.

The HNS metal jacket detonating cord has an explosive core of heranitrostilbene; a metal jacket of lead; and a temperature rating of 500° F.

The PYX metal jacket detonating cord has an explosive core of 2,6-Bis(Picrylamino)-3,5-Dinitropyridine; a metal jacket of aluminum and a temperature rating of 540° F.

The diameter of each of the HMX, HNS and PYX metal jacket detonating cords is about 0.220 of an inch.

It has been found that the HMX, HNS and PYX metal jacket detonating cords do not need the severing means 39 of the embodiments of FIGS. 2–6 and in fact it has been found that the severing means 39 will not work effectively to stop detonation of the HMX, HNS and PYX metal jacket detonating cords should detonation occur. The HMX, HNS and PYX metal jacket detonating cords can be wound and assembled on stacked separator-support members in the same manner described with reference to FIGS. 2–6 except that the severing means 39 will be eliminated. As described with reference to FIGS. 2–6 the detonating cord portions 57 and 59 of the HMX, HNS and PYX metal jacket detonating cords will cross each other (as seen in a plan view) at the locations 38 on each separator-support member 35 at which locations they will engage each other (and hence are located in proximity to each other) as seen in FIG. 10 and will be held in this position by the winding support means and adjacent stacked separator-support members 35 bound together by the strapping tape and the package container. The metal jacket detonating cord also may be wound such that it progresses back and forth from near row to far row, etc., with no crossovers. With such an arrangement, suitable securing means will be provided to cause the metal jacket detonating cord to pass in close lateral proximity with itself at severing locations located between the near and far rows of winding support members. The securing means may be suitable pull ties employed to tie the metal jacket detonating cord to itself at the severing locations such each of the severing locations the cord engages itself. It has been found that it is not necessary for the metal jacket detonating cord to engage itself at the severing locations for the system to operate. In this respect, if the portions of the metal jacket detonating cord are spaced apart about ⅛ of an inch with no crossover at the severing locations, the cord will still sever itself to stop detonation should it occur. The portions of the metal jacket detonating cord may be secured close together but spaced apart at each of the severing locations by using pull ties to tie the two cord portions to the separator-support member such that a gap is formed between the two cord portions. Each pull tie would extend around each of the two cord portions respectively and extend through apertures formed through the separator-support member and its two ends tied together on the back side of the separator-support member. Suitable pull ties are disclosed at 63 in FIGS. 3 and 4 of U.S. Pat. No. 4,586,602. By assembling a continuous length of metal jacket detonating cord on the separator-support members 35 without the severing means 39 as described above, it has been found that if a detonation of the cord is initiated at any location on or within the detonating cord transport package, the detonation will travel in opposite directions from the ignition point but the metal jacket detonating cord will sever itself at the first severing location encountered.

The drawings are merely illustrative of the principles of this invention and are not to be interpreted in a limiting sense.

We claim:

1. A detonating cord transport package comprising a plurality of sections, with each section comprising:

a detonating cord separator-support member having front and back face surfaces and edge surfaces, and a continuous length of detonating cord comprising a metal jacket surrounding an explosive core along said entire continuous length, disposed for support on said separator-support member and traversing portions of said surfaces such that said detonating cord is formed in a plurality of loops on said separator-support member, each of said loops having two end portions engaging each other at a severing location to allow said detonating cord to sever itself should detonation of said cord occur.

2. A detonating cord transport package comprising:

a plurality of separator-support members located in layers, a continuous length of detonating cord comprising a metal jacket surrounding an explosive core, along said entire continuous length disposed for support on said separator-support members, and each of said support members having at least on one side thereof a portion of said detonating cord which traverses said side such that said detonating cord is formed in a plurality of loops on said one side with each of said loops having two end portions engaging each other at a severing location to allow said detonating cord to sever itself should detonation of said cord occur.

3. The detonating cord transport package of claim 2, wherein: said two end portions of each of said loops of said detonating cord cross each other at said severing locations as seen in a given view.

4. A detonating cord transport package comprising:

a plurality of support members located in layers, each of said support members having at least one support side with all of said one support sides of said support members facing in the same direction, and a continuous length of detonating cord comprising a metal jacket having an explosive core, disposed for support on said support members, said detonating cord being formed in a plurality of loops on each of said support members whereby each of said support members supports a plurality of said loops of detonating cord, each of said loops of detonating cord having two end portions engaging each other at a given location on said one support side of its supporting support member to allow said detonating cord to sever itself should detonation of said cord occur, said given locations on said one support side of each of said support members being spaced from each other.

5. The detonating cord transport package of claim 4, wherein:

at each of said locations, said two end portions of each of said loops of said detonating cord cross each other as seen in a given view.

6. A detonating cord transport package comprising a plurality of stacked sections, with each section comprising:

a detonating cord separator-support member having front and back face surfaces and edge surfaces;

detonating cord winding support means disposed interiorly of said edge surfaces of said separator-support member;

a continuous length of detonating cord comprising a metal jacket surrounding an explosive core, windingly disposed on said winding support means such that there are a plurality of severing locations where a second detonating cord portion is disposed in proximity with a first detonating cord portion, said winding support means projects from said separator-support member front face surface and said length of detonating cord traverses portions of said separator-support member front face surface.

7. The detonating cord transport package of claim 6 wherein:

said separator-support members each have a plurality of openings extending therethrough and communicating between said front and back face surfaces;

said winding support means comprises a plurality of columnar winding support members that extend through said openings in said separator-support members, wherein each section comprises portions of said columnar winding support members.

8. The detonating cord transport package of claim 6 wherein:

said separator-support members each have a plurality of openings extending therethrough and communicating between said front and back face surfaces, said winding support means comprises a plurality of columnar winding support arrangements, wherein each of said columnar winding support arrangements comprises a plurality of columnar members that extend through said openings in said separator-support members, and wherein each section comprises portions of said columnar members.

9. The detonating cord transport package of claim 6, wherein:

at each of said locations, said first and second detonating cord portions engage each other.

10. The detonating cord transport package of claim 9, wherein:

at each of said locations, said first and second detonating cord portions cross each other as seen in a given view.

11. A detonating cord transport package comprising a plurality of stacked sections, with each section comprising:

a detonating cord separator-support member having front and back faces and side edges located in a given plane;

a plurality of spaced apart detonating cord winding support means disposed on said separatorsupport member;

a continuous length of detonating cord comprising a metal jacket surrounding an explosive core, windingly disposed on said plurality of winding support means such that there are a plurality of spaced apart severing locations where a second detonating cord portion is disposed in proximity with a first detonating cord portion;

each of said detonating cord winding support members comprises surface means transverse to said plane of said side edges around which said continuous length of detonating cord is at least partially looped.

12. The detonating cord transport package of claim 11 wherein:

said separator-support members each have a plurality of openings extending therethrough and communicating between said front and back faces thereof, said plurality of winding support means extend through said plurality of openings respectively in said separator-support members, wherein each section comprises portions of said winding support means.

13. The detonating cord transport package of claim 12, wherein:

at each of said locations, said first and second detonating cord portions engage each other.

14. The detonating cord transport package of claim 13, wherein:

at each of said locations, said first and second detonating cord portions cross each other as seen in a given view.

15. A detonating cord transport package comprising a plurality of sections, with each section comprising:

a detonating cord separator-support member having front and back face surfaces and edge surfaces, and a continuous length of detonating cord comprising a metal jacket surrounding an explosive core along said entire continuous length, disposed for support on said separator-support member and traversing portions of said surfaces such that said detonating cord is formed in a plurality of loops on said separator-support member, each of said loops having two end portions in proximity to each other at a severing location.

said two end portions at each of said severing locations being spaced apart with a gap formed therebetween sufficient to allow said detonating cord to sever itself at one of said severing locations should detonation of said cord occur.

16. A detonating cord transport package comprising:

a plurality of separator-support members located in layers, a continuous length of detonating cord comprising a metal jacket surrounding an explosive core along said entire continuous length, disposed for support on said separator-support members, and each of said support members having at least on one side thereof a portion of said detonating cord which traverses said side such that said detonating cord is formed in a plurality of loops on said one side with each of said loops having two end portions in proximity to each other at a severing location.

said two end portions at each of said severing locations being spaced apart with a gap formed there between sufficient to allow said detonating cord to sever itself at one of said severing locations should detonation of said cord occur.

17. A detonating cord transport package comprising a plurality of sections, with each section comprising:

a detonating cord separator support member having front and back face surfaces and edge surfaces, and a metal jacket, with an exterior surface, surrounding an explosive core, along said entire continuous length, disposed for support on said separator-support member and traversing portions of said surfaces such that said detonating cord is formed in a plurality of loops on said separator-support member, each of said loops having two end portions in proximity to each other at a severing location with no material located between and in contact with the exterior surfaces of said two end portions to allow said detonating cord to sever itself should detonation of said cord occur.

18. The detonating cord transport package of claim 17, wherein:

said two end portions at each of said severing locations have no solid material located between and in contact with the exterior surfaces of said two end portions.

19. A detonating cord transport package comprising:

a plurality of separator-support members located in layers, a continuous length of detonating cord comprising a metal jacket with an exterior surface surrounding an explosive core along said entire continuous length, disposed for support on said separator-support members, and each of said support members having at least on one side thereof a portion of said detonating cord which traverses said side such that said detonating cord is formed in a plurality of loops on said one side with each of said loops having two end portions in proximity to each other at a severing location with no material located between and in contact with the exterior surfaces of said two end portions to allow said detonating cord to sever itself should detonation of said cord occur.

20. The detonating cord transport package of claim 19, wherein:

said two end portions at each of said severing locations have no solid material located between and in contact with the exterior surfaces of said two end portions.

* * * * *